US007498753B2

(12) United States Patent
McAvoy et al.

(10) Patent No.: US 7,498,753 B2
(45) Date of Patent: Mar. 3, 2009

(54) COLOR-COMPENSATING FLUORESCENT-LED HYBRID LIGHTING

(75) Inventors: Michael B. McAvoy, Lynnwood, WA (US); Ty A. Larsen, Everett, WA (US); Richard A. Cote, Mill Creek, WA (US)

(73) Assignee: The Boeing Company, Chicago, IL (US)

( * ) Notice: Subject to any disclaimer, the term of this patent is extended or adjusted under 35 U.S.C. 154(b) by 161 days.

(21) Appl. No.: 11/618,747

(22) Filed: Dec. 30, 2006

(65) Prior Publication Data

US 2008/0158871 A1 Jul. 3, 2008

(51) Int. Cl.
*H05B 37/02* (2006.01)

(52) U.S. Cl. ..... 315/291; 315/158; 315/308

(58) Field of Classification Search ..... 315/209 R, 315/246–247, 291, 294, 307–309, 312, DIG. 4, 315/149–150, 156, 158; 345/82–84, 102, 345/204; 362/227

See application file for complete search history.

(56) References Cited

U.S. PATENT DOCUMENTS

| | | | | |
|---|---|---|---|---|
| 6,860,628 | B2 | 3/2005 | Robertson et al. | |
| 7,183,727 | B2 * | 2/2007 | Ferguson et al. | 315/308 |
| 7,391,172 | B2 * | 6/2008 | Ferguson et al. | 315/308 |
| 2005/0237754 | A1 | 10/2005 | Klettke | |
| 2005/0237766 | A1 | 10/2005 | Klettke | |
| 2006/0038511 | A1 * | 2/2006 | Tagawa | 315/291 |
| 2006/0152172 | A9 * | 7/2006 | Mueller et al. | 315/291 |
| 2006/0268544 | A1 * | 11/2006 | Rains, Jr. et al. | 362/231 |
| 2007/0258240 | A1 * | 11/2007 | Ducharme et al. | 362/231 |
| 2008/0062115 | A1 * | 3/2008 | Brown | 345/102 |

OTHER PUBLICATIONS http://www.erieaviation.com/lighting.htm, no date.
http://www.aerospace-technology.com/company_printable.asp?ProductSubGroupID=666&CompanyID=30153, no date.
http://www.my-led.de (translation obtained by clicking on notation for English version on German web page), no date.
http://www.diehl-aerospace.de/index.php?id=1345&L=1 (Diehl Aerospace Interior Lighting web pages), no date.
http://www.pageaerospace.co.uk/PRO10824.htm (Page Aerospace programmable ambience-enhancing cabin lighting), no date.

* cited by examiner

*Primary Examiner*—David Hung Vu
*Assistant Examiner*—Tung X Le
(74) *Attorney, Agent, or Firm*—Ostrager Chong Flaherty & Broitman P.C.

(57) ABSTRACT

A hybrid fluorescent-LED lighting system comprising a controller, LED elements, fluorescent lamp, and a color/brightness sensor, wherein the color/brightness sensor measures a combined light output of both the fluorescent lamp and the LED elements. A method for controlling the hybrid fluorescent LED lighting system includes receiving a request for brightness/color, setting a fluorescent lamp output to a particular brightness level, setting output of LEDs to a particular brightness level, measuring a combined output of the fluorescent lamp and LEDs; and adjusting the output of LEDs until the total output of the fluorescent lamp and LEDs matches the request for brightness/color. Adjusting the output of LEDs may include the step of driving a specific spectrum range of the LEDs as necessary in order to fill-in variances in a spectrum range of the fluorescent lamp. The method further allows modifying the color of light output. The method also provides a smooth transition from a current state of the lighting system to the received request for brightness/color by over-driving the LEDs beyond a steady state design rating of the LEDs.

23 Claims, 5 Drawing Sheets

COLOR-COMPENSATING FLUORESCENT-LED HYBRID LIGHTING

FIELD OF THE INVENTION

The present invention relates to lighting control systems and, more particularly, to color-compensating fluorescent-Light Emitting Diode ("LED") hybrid lighting.

BACKGROUND OF THE INVENTION

Traditional airplane interior lighting systems typically use fluorescent lamps. This technology currently provides the best efficiency available, requiring less electrical power, and producing less heat than other methods. However, fluorescent lamps can have a significant variance in brightness and color, and these properties can change with age. This can be quite noticeable in a system with multiple fluorescent lamps, and can detract from an interior design. Additionally, control of fluorescent lamps is limited. Typical installations will have three modes: off, bright, and dim, without any smooth transitions between. Continuously dimmable systems are available, but with a significant cost and weight penalty, and such systems still cannot be dimmed smoothly to and from an off condition.

Dynamic LED lighting systems (as used, for example, on the Boeing 787 aircraft) utilize multi-color LED elements to allow finely variable brightness and to introduce color-changing capabilities. Additionally, most dynamic LED systems include a calibration feature to ensure consistency across the installation. Calibration may be performed during manufacturing, or the system may include self-sensing to perform automatic and continuous calibration during operation.

The primary drawback to this type of dynamic LED lighting system is that the LEDs currently in use are not particularly energy-efficient when the design goal is to create large amounts of white light. Use of dynamic LED lighting systems increases power demands and waste heat, which in turn increases weight in the electrical power generation, distribution, light housings, heat sinks, and cooling systems, in comparison to a purely fluorescent-based system.

Previous consideration has been made to using a hybrid system that uses both LEDs and fluorescent lights. Typically, when full brightness is needed, white light is also desired. The fluorescent lights are utilized to improve efficiency during peak demand times. The LED elements are used for lower brightness levels, when the inefficiency is less of an issue, and when the full spectrum color variability would be used to provide enhanced mood lighting not possible with the fluorescent lamps. In effect, they operate as if they were two separate systems that are installed side-by-side, and current designs are not taking the full benefit of using them together.

A hybrid system has not been implemented, primarily because the "bright" fluorescent mode still exhibits all the consistency problems of a traditional fluorescent system. LED systems were introduced as a means to solve these problems as well as provide highly distinguishing mood lighting. Their combination together in the currently available hybrid designs has never attracted much interest, however, because such current designs seem to have the worst of all problems associated with both technologies.

It is therefore desirable to take a new approach of marrying the technologies together as if they were a single light source to allow for an improved hybrid design that takes advantage of the strengths of both technologies, rather than to follow the traditional method of operating both technologies as stand alone items that just happen to share the same enclosure.

SUMMARY OF THE INVENTION

This invention is a hybrid fluorescent/LED lighting system that utilizes LEDs to compensate for color and brightness variations in the fluorescent lamps, while still operating as full gamut mood lighting at lower light levels when the fluorescent lamps are not used. At low brightness (cabin illuminance) levels, the lighting system operates in a dynamic LED mode with full RGB color control, but at high or intermediate levels instead of turning the LEDs off and relying on the fluorescent lamp source, the LEDs are used to supplement the primary fluorescent lamps. Each LED segment is calibrated to compensate for differences in the related fluorescent lamp (or lamps), bringing the total light assembly luminous flux output and chromaticity to a consistent level and color quality. The inventive lighting system allows passenger cabin lighting to be operated in the high brightness and high efficiency mode expected from a purely fluorescent based system while simultaneously utilizing the beneficial highly selective color control of the LEDs operating at low power levels to enhance the white light output of the fluorescent lamps. Additionally, it enables low level full-gamut color control or "mood lighting", using solely LED lamps

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE INVENTION

Figure 1:
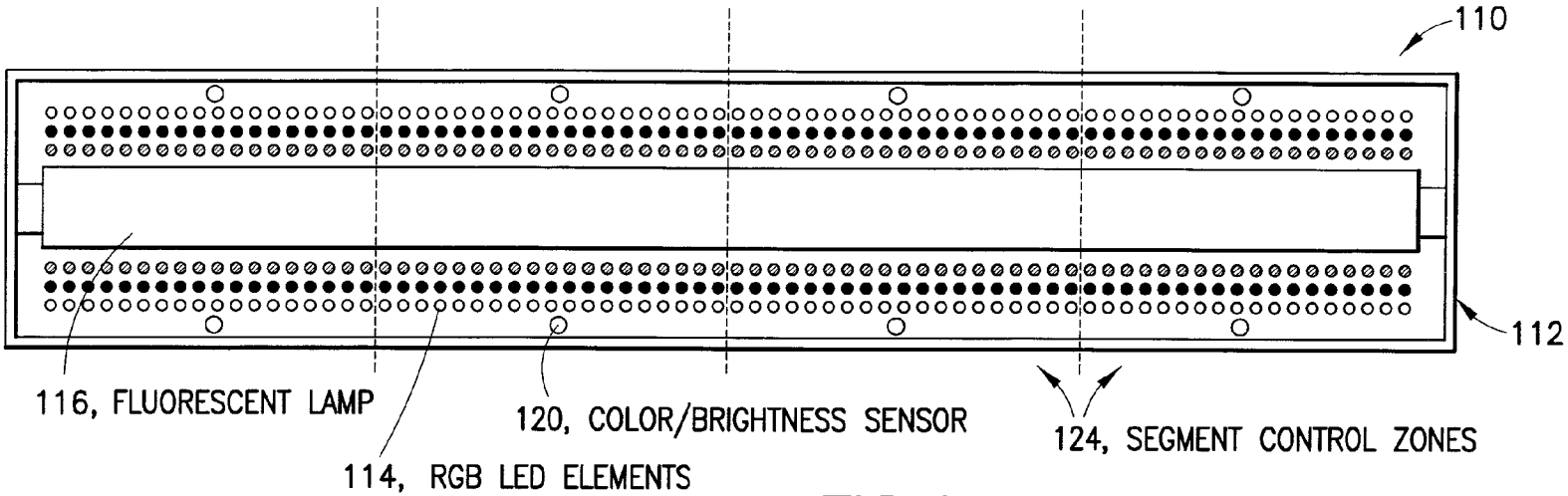
FIG. 1 is a hybrid fluorescent-LED lighting system according to the present invention.

The invention is a hybrid fluorescent-LED lighting system that utilizes LED lamps even while the fluorescent lamps are operating, in order to compensate for variances in the brightness and chromaticity among fluorescent lamps. In FIG. 1, the hybrid fluorescent-LED lighting system 110 comprises a reflective housing 112, RGB LED elements 114, fluorescent lamp 116, diffuser 118, and color/brightness sensors 120. The lighting system 110 may comprise LED segment control zones 124, with each zone 124 comprising at least one color/brightness sensor 120. The sensor 120 measures total light output from both the fluorescent lamp 116 and RGB LED elements 114.

Figure 2:
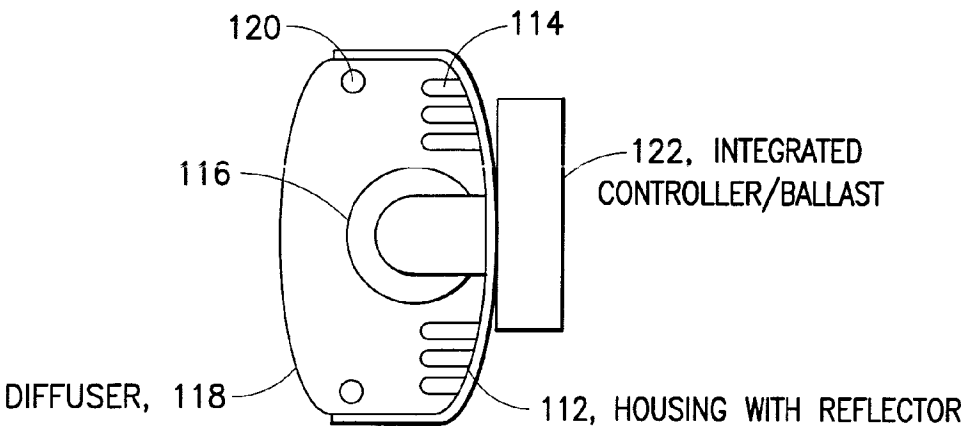
FIG. 2 is a cross-section of the hybrid fluorescent-LED lighting system shown in FIG. 1.

FIG. 2 shows a cross section of the lighting system 10. As shown in FIG. 2, the lighting system 110 further comprises a fluorescent controller or ballast 122. FIG. 2 also shows that RGB LED elements 114 are disposed to opposite sides of fluorescent 116.

Figure 3:
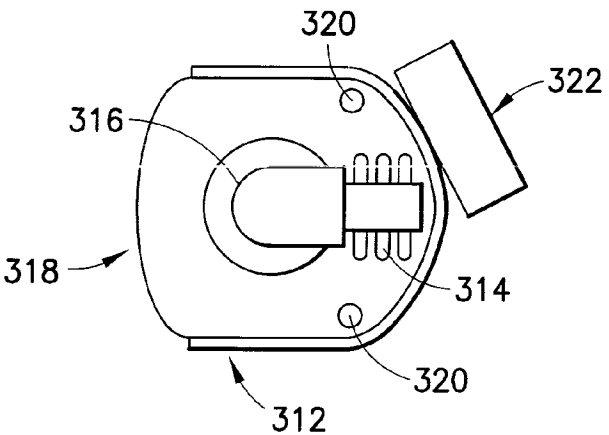
FIG. 3 is another embodiment of a hybrid fluorescent-LED lighting system according to the present invention.

Yet another embodiment of the invention is shown in FIG. 3, where the reflective housing 312 has a configuration different from that of reflective housing 112 depicted in FIGS. 1 and 2. For the reflective housing 312 of FIG. 3, the RGB elements 314 are side by side rather than having the fluorescent lamp 316 there in between, as depicted in FIGS. 1 and 2.

Figure 4:
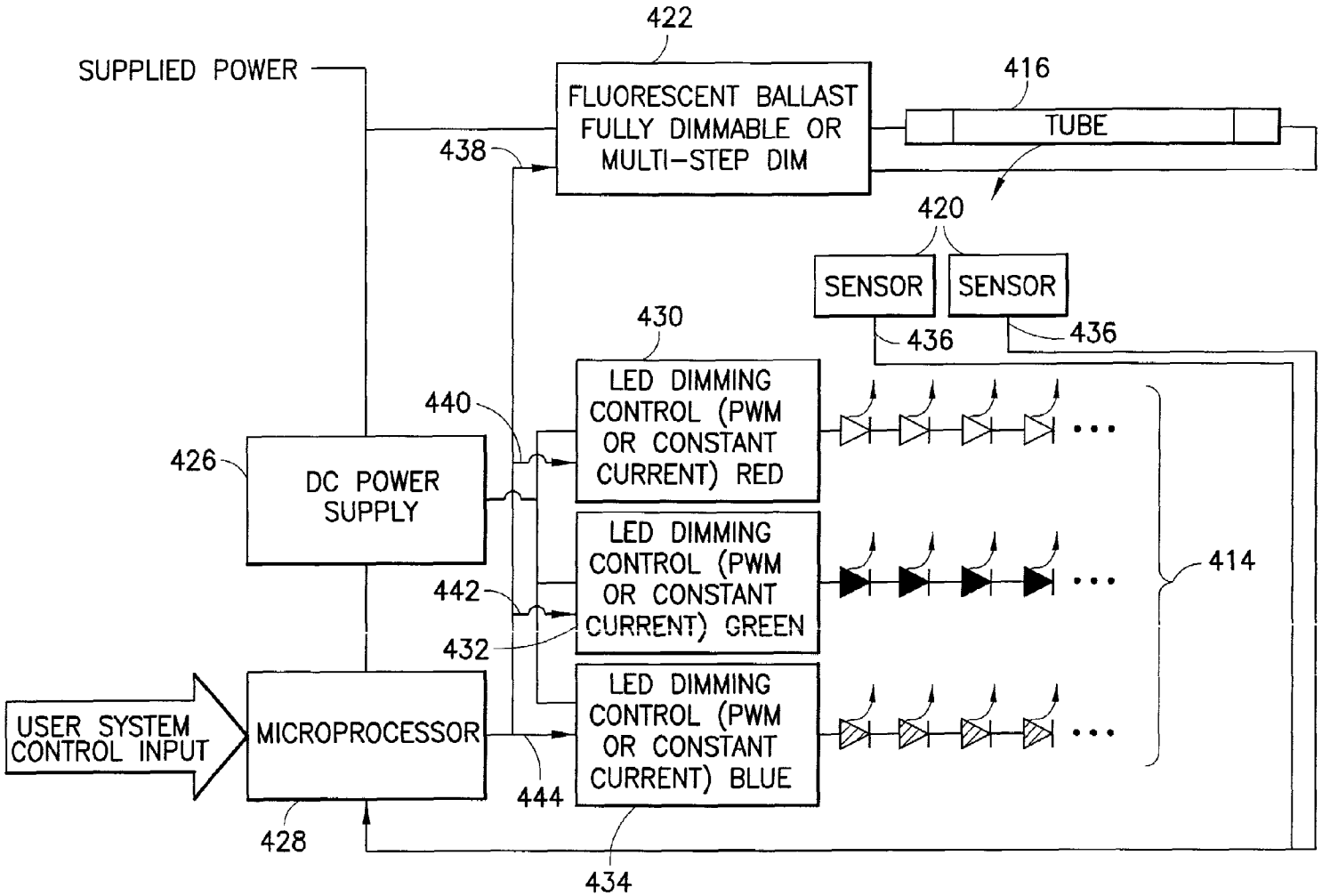
FIG. 4 is a detail showing various components of a hybrid fluorescent-LED lighting system according to the present invention.

In another aspect of the invention, FIG. 4 shows a schematic diagram. DC power supply 426 supplies power to the various components depicted in FIG. 4 including controller 428, fluorescent ballast 422, color/brightness sensors 420, Red LED control 430, Green LED control 432, Blue LED control 434, and LED elements 414. Controller 428 is a logic control device such as a microcontroller, having appropriate inputs, outputs, and logic processing capability. LED controls 430, 432, and 434 have pulse width modulation or constant current dimming control capabilities. Color/brightness sensors 420 mimic the human eye tri-stimulus color response. Fluorescent ballast 422 controls the voltage and current to fluorescent lamp 416, as is known in the art. In one embodiment of the invention, fluorescent ballast 422 may be of a type that is multi-step dimmable. In another embodiment of the invention, fluorescent ballast 422 may be fully dimmable. In either case, these ballasts feature control inputs that would allow them to be controlled in conjunction with the LED lighting system, whether by discrete switching, analog signals, or digital signals. These types of ballast are known in the art.

Referring to FIG. 4, controller or microprocessor 428 takes user/system control input 446, by an attached computer and network (not shown) which in turn is connected to any number of control panel or other user interfaces. Controller or microprocessor 428 is programmed in such a way to determine input 446 and make decisions on how to control the fluorescent ballast 422 and LED controls 430, 432, and 434. Microprocessor 428 controls Red LED control 430 via Red LED control line 440; Green LED control 432 via Green LED control line 442; and Blue LED control 434 via Blue LED control line 444. In a similar fashion, microprocessor 428 controls fluorescent ballast 422 via ballast control line 438.

Figure 5:
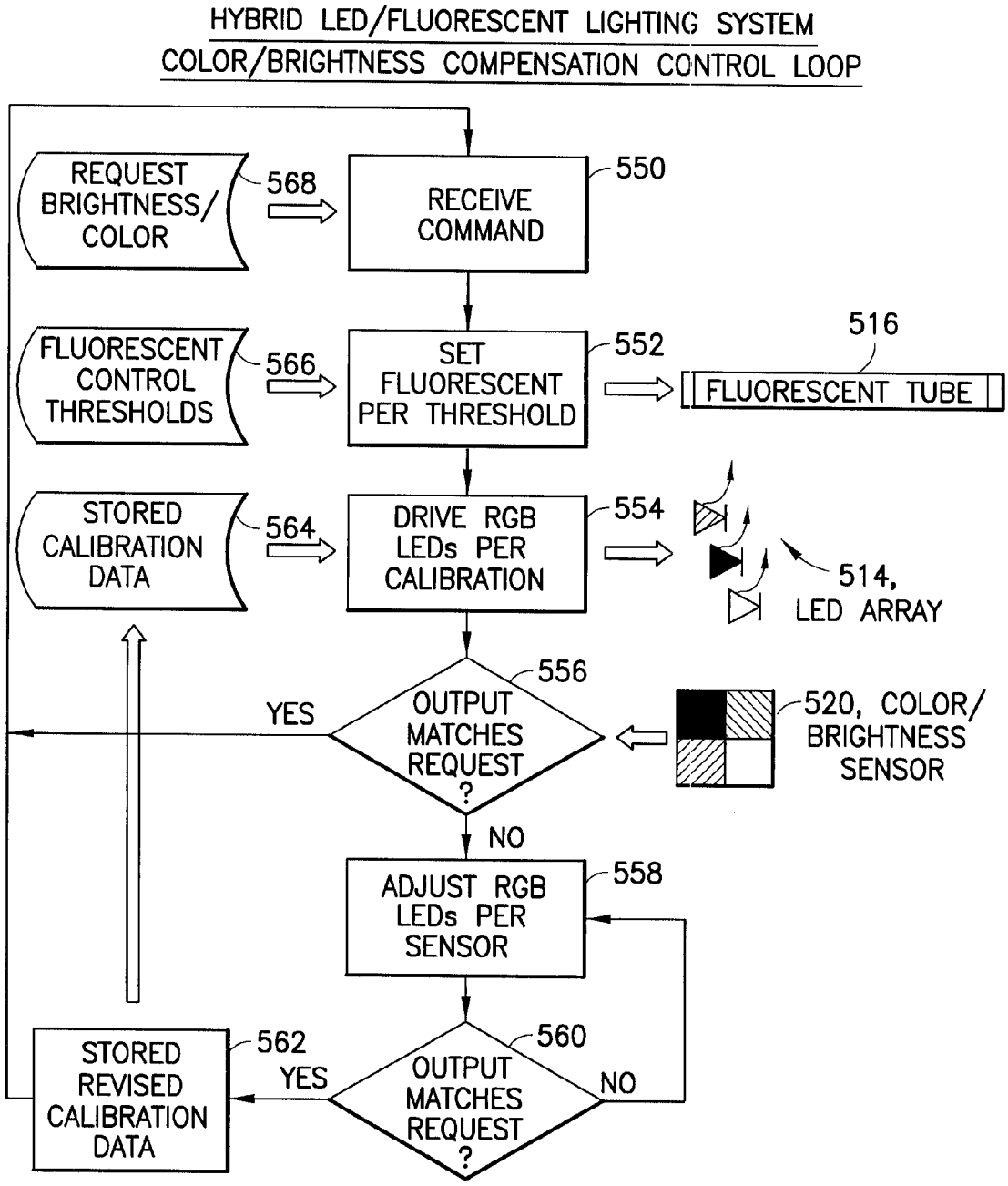
FIG. 5 is a flowchart detailing the logic used to operate a hybrid fluorescent-LED lighting system according to the present invention.

Referring to FIG. 5, another aspect of the invention is shown, which shows the logic carried out in controller or microprocessor 428 of FIG. 4. In step 550 of FIG. 5, the inventive lighting system receives a command by way of user request for brightness/color 568. In step 552, the fluorescent ballast is set according to a threshold retrieved from fluorescent control thresholds 566 stored in memory. As a result of carrying out step 552, fluorescent tube 516 is set to the particular brightness level according to fluorescent control thresholds 564. In step 554, RGB LEDs are driven to stored calibration data 564 stored in memory. As a result of carrying out step 554, LED array elements are set to the particular brightness level according to stored calibration data 564.

In step 556, the output of color/brightness sensor 520 is read and then compared to request brightness/color 566. If the output of color/brightness sensor 520 matches the value of request brightness/color 566, processing continues to step 550 and repeats the loop as described above.

However, if the output of color/brightness sensor 520 does not match the value of user request for brightness/color 566, the RGB LEDs are adjusted in step 558, based on the difference in the commanded values, and those measured by the sensor 520. The output of color/brightness sensor 520 is read again and then compared to request brightness/color 568 in step 560. If the value still does not match, further adjustments and measurements are made, looping until a match has been achieved. Once an adjusted LED calibration has matched the commanded levels, the revised calibration data 562 is stored to memory, and processing continues as described above.

If the user request for brightness/color 568 is not for "dim," i.e., the request 568 is for "bright" or any intermediate modes, the fluorescent lamps are the primary illumination sources. The required brightness and RGB levels are set slightly above the nominal values of a typical fluorescent lamp, with just enough design margin so that chromaticity tolerances among lamps will not exceed the desired level. The LEDs are operated at low power levels in parallel with the fluorescent lamps, to correct the spectral content as required, thus eliminating distinguishable color variations inherent among the fluorescent lights. In one embodiment of the invention, the chromaticity of the light produced by the fluorescent assembly is modified to a desired correlated color temperature or "tint" by, for example, adding red hues to a generally bluish fluorescent lamp to "warm up" the visible light.

The LED levels required to correct the chromaticity of the fluorescent assembly are determined by a calibration process depicted in FIG. 5, in which the actual chromaticity of the fluorescent assembly is compared with a reference or "target" chromaticity. Ideally in the preferred embodiment, the lighting system would include color and brightness sensors capable of estimating the actual luminous flux produced or "light output" (both LED and fluorescent), and the controller would incorporate a feedback loop to adjust the LED levels as necessary. The controller, such as microprocessor 428 in FIG. 4, may also incorporate a memory so that as it is switched to a new brightness level, it can recall previous calibration points instead of performing a gross recalibration each time.

In another embodiment of the invention, the system uses an external calibration tool containing the color and brightness sensors. Such a tool is known in the art. Typically, the tool would be placed in a reference location. Calibration is requested via software. Color and intensity measurements are taken then compared to current light settings. Adjustments would be made if necessary. Such a tool would be used after installation or maintenance, or as needed, to measure the fluorescent, LED, and combined light output for various modes or tests to determine the supplemental LED power levels required. This calibration data is programmed into the lighting controller, such as controller 428.

If the user request for brightness/color 568 is for "dim," the controller 428 switches off fluorescent lamp 416, and the lighting system operates as an LED-only system, restricted to lower power levels. Full dynamic color capability ("mood lighting") would therefore be available in these low power modes.

Figure 6:
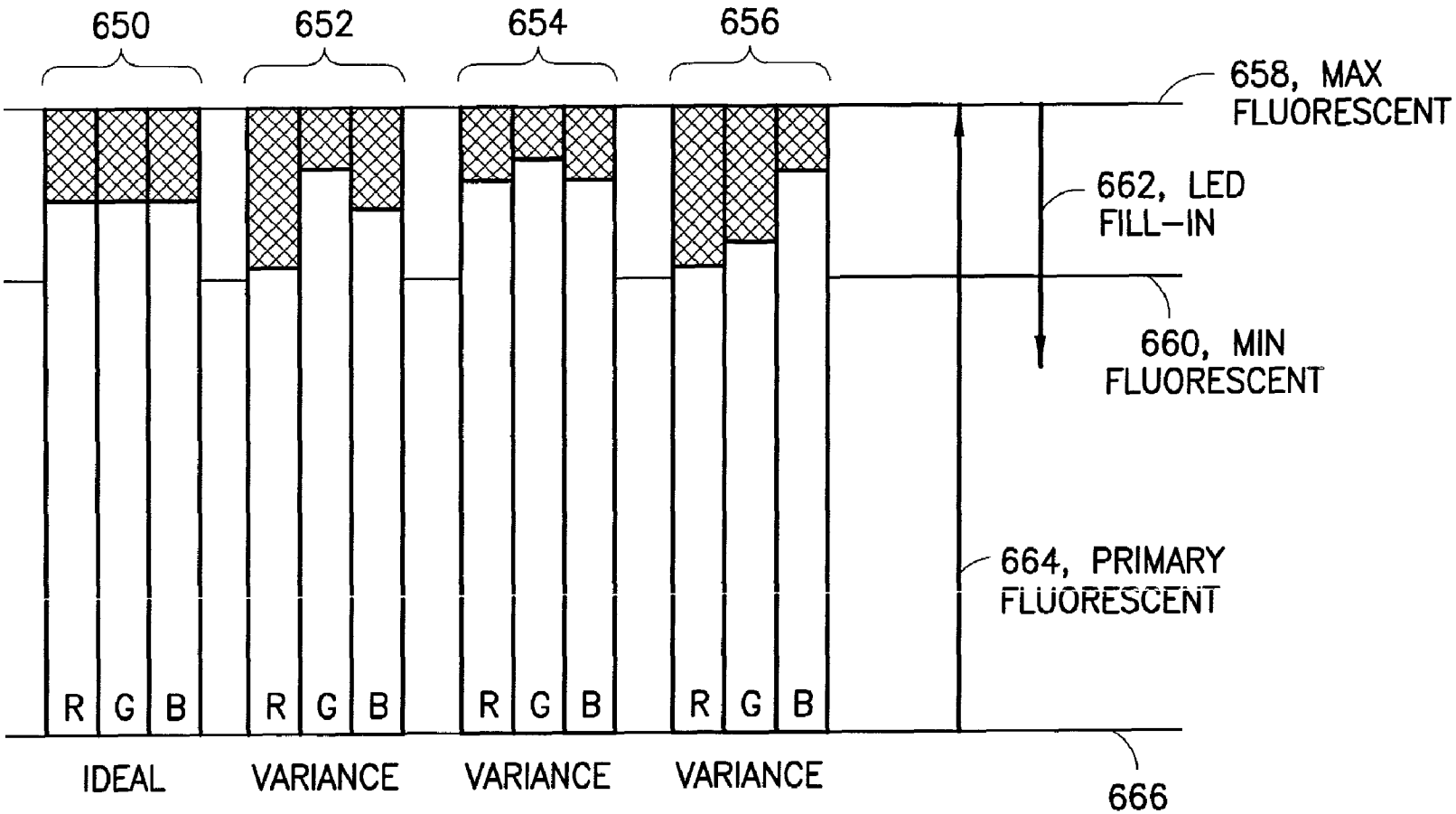
FIG. 6 depicts an aspect of the present invention whereby LEDs may be used to compensate output variances in fluorescent lamps.

Referring now to FIG. 6, another aspect of the invention is shown wherein LEDs are used to compensate output variances in fluorescent lamps. Light outputs 650, 652, 654, and 656 depict output variances in fluorescent lamps. Each of light outputs 650, 652, 654, and 656 is shown as being separated into an RGB spectrum, with the bars indicating either R, G, or B. The bottom bars (i.e., the non-cross-hatched bars) represent the fluorescent bar output. An ideal fluorescent light output would have equal parts red, green, and blue, with a particular luminous flux output. Such an ideal fluorescent light output is depicted in light output 650. However, because of variances among lamps, some lamps may have more or less output in any range of the spectrum. By way of example, such variances are shown in light outputs 652, 654, and 656. The "Max Fluorescent" 658 and "Min Fluorescent" 660 represent the probable range of output of a lamp. "Max Fluorescent" 658 also represents the required brightness level as, for example, requested by a particular user. The upper bars (i.e., the cross-hatched bars) represent the RGB LED outputs and how they "fill-in" for the output inconsistencies or variances in fluorescent lamps. As previously described, this is accomplished by the system described in the discussion of FIG. 4 in conjunction with the method described in the discussion of FIG. 5 above.

Figure 7:
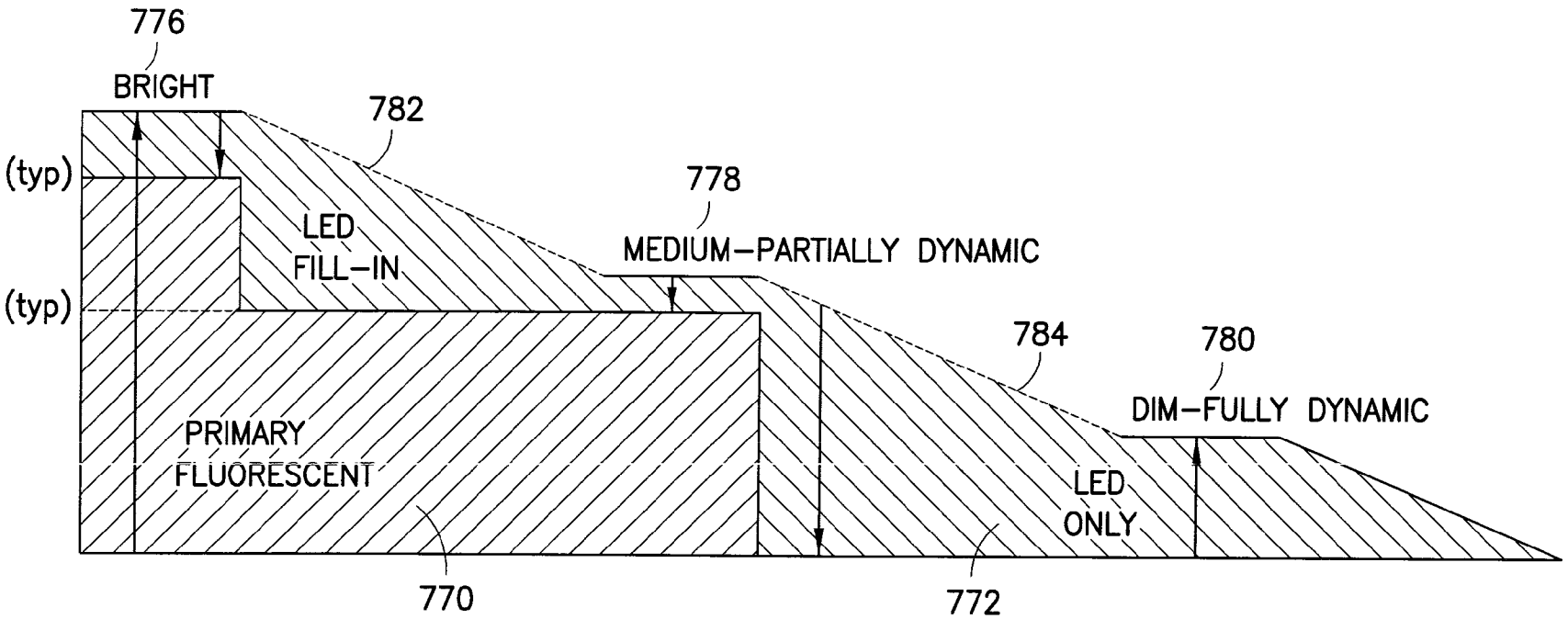
FIG. 7 depicts an aspect of the present invention wherein LED elements may be used in order to smooth the step transitions of a multi-step fluorescent dimming scheme.

In another aspect of the invention, LED elements may be used in order to smooth the step transitions of a multi-step fluorescent dimming scheme. This is illustrated in FIG. 7, which shows for illustration purposes three levels of brightness: bright, medium brightness, and dim (LED only), with transitions in between such levels. In bright mode 776, brightness is attributed mostly to the output of the fluorescent lamp, which is indicated by the cross-hatched area 770. The other cross-hatched area 772 is the output from the LED elements, which are used to "smooth-out" the transitions from bright 776 to medium brightness 778 to dim (LED only) 780. (In other words, the LEDs provide a continuously adjustable brightness and eliminate the steps in brightness.) The transitions are indicated by the dotted lines marked 782 and 784. Thus, rather than having only step transitions between the different modes (i.e., from bright 776 to medium 778 to dim 780), the transitions are made in a more continuous or "smooth" fashion by utilizing the luminous flux produced by the LED lamps.

The inventive approach provides design advantages due to the removal of complicated fully dimmable fluorescent ballasts, and instead relying on the fully dimmable LED drivers (already installed to support chromaticity correction and mood lighting) to provide smooth lighting transitions of the system as a whole. In order to enable smooth transitions between brightness modes, the LEDs may be "over-driven" beyond a steady-state design rating. This would have a poor efficiency and high heat output, but would be acceptable as the condition would only last for several seconds at a time. Thus, for example, to transition between a bright and medium brightness, the fluorescent lamp would be instantly switched. Simultaneously, the LEDs would be stepped from a low-power fill, to a high-power overdrive fill. The total light output and chromaticity would remain the same. The LED power output would then be gradually reduced over several seconds to their low-power fill levels for the medium brightness mode, giving the appearance of a smooth, stable dimming of the lights.

Transitioning from a medium brightness mode to a dim LED-only mode would be similar. The fluorescent lamp is switched off, while the LEDs are simultaneously stepped to a high-power overdrive level equivalent to the medium brightness. Again, the LEDs would then be gradually reduced to lower power levels, fading to the dynamic color required (selected by the user). The LEDs can also be smoothly dimmed all the way to a full-off mode.

The process may be reversed to enable continuous transitions from off or dim levels to high brightness levels.

The physical structure of the system is similar to existing hybrid systems, in that it utilizes both fluorescent and multi-color LED lamps, and has a means for the user to select brightness levels and dynamic color settings. The inventive lighting system would contain the LED drivers and fluorescent lamp ballast, and may contain the self-monitoring color and brightness sensors, as well as the logic necessary to measure and/or store the calibration levels needed to accurately drive the LEDs to correct the chromaticity and to achieve continuous smooth dimming of the fluorescent lamps.

In another embodiment of the invention, the control system is mounted "off board" and remote from the lighting arrays, such as in a centralized computer system. In yet another embodiment, the user input controls are mounted remotely, such as in attendant lighting control panels. In such a setup, communications and control is implemented via wired communications techniques. In another embodiment, communications is implemented via wireless communications techniques. In a further embodiment communications are implemented using fiber optics.

In another embodiment, fluorescent lamps may be replaced by any high-efficiency light source. In another embodiment, the RBG LED lamps may be replaced by any multi-color full-gamut capable light sources.

This inventive lighting system is different from prior hybrid systems in that it does not operate solely as an LED system or solely as a fluorescent system. In the inventive lighting system, the LEDs are used to supplement and enhance the fluorescent system. The LED elements are used during high brightness fluorescent modes to compensate for chromaticity or correlated color temperature variations among lamps, while also allowing the possibility of slight correlated color temperature or "tint" changes to be made as is typical of an all-LED mood lighting system. Then at low light levels the system would convert to an all-LED only mood lighting system. It is believed that this technique will result in a more efficient and lighter weight lighting system than an all-LED solution, while still providing the desirable features of all-LED mood lighting. Although the inventive lighting system is not capable of operating in a full gamut mood lighting mode at high brightness, such a feature is unnecessary because mood lighting modes are generally used during low light ambient conditions.

Although the invention has been illustrated and described with specific embodiments, it will be appreciated that various changes can be made therein without departing from the spirit and scope of the invention. Further, the inventive lighting system may be used for any lighting system where bright, consistent chromaticity or correlated color temperature white lighting or tint-variable white lighting is desired, and is especially suitable where lower-level dynamic full gamut color control is also used. This could be applicable to any transportation system, commercial, or residential lighting system where consistent and/or dramatic lighting is desired, and high efficiency and/or low heat generation is an issue. Large scale architectural exterior lighting may also benefit. The inventive lighting system thus provides the desired consistency and dynamic capabilities of an LED-based system, with high-brightness efficiencies and thermal qualities closer to that of a fluorescent-based system. Within the scope of the appended claims, it is to be understood that the invention can be practiced otherwise than as specifically described herein.

What is claimed is:

1. A lighting system comprising:

LEDs;

a multi-step dimmable fluorescent lamp;

a color/brightness sensor wherein the color/brightness sensor measures a combined light output of both the fluorescent lamp and the LEDs; and a controller programmed to:

receive a request for a combined light output level;

gradually adjust the output of the LEDs from an initial LED power fill to a first transient LED power fill;

step the fluorescent lamp from a first fluorescent power level to a second fluorescent power level, while stepping the LEDs from the first transient LED power fill to a second transient LED power fill such that the combined light output of the fluorescent lamp and the LEDs remains the same; and gradually adjust the output of the LEDs from the second transient LED power fill to a final LED power fill such that the combined light output of the fluorescent lamp and the LEDs reaches the request for the combined light output level.

2. The lighting system of claim 1 further comprising at least one segment control zone.

3. The lighting system of claim 2 wherein said at least one segment control zone comprises at least one color/brightness sensor.

4. The lighting system of claim 1 further comprising a fluorescent ballast.

5. The lighting system of claim 1 wherein the LEDs are disposed to opposite sides of the fluorescent lamp.

6. The lighting system of claim 1 wherein the LEDs are disposed next to each other on the same side of the fluorescent lamp.

7. The lighting system of claim 1 further comprising LED controls.

8. The lighting system of claim 1 wherein the LED controls are high brightness LED drivers with pulse width modulation dimming capabilities.

9. The lighting system of claim 1 further comprising an input for user requirement for brightness level.

10. The lighting system of claim 1 wherein any high efficiency light source is used in place of the fluorescent lamp.

11. The lighting system of claim 1 wherein any multi-color full-gamut capable light source is used in place of LEDs.

12. The lighting system of claim 1 wherein:

the initial LED power fill is higher than the first transient LED power fill;

the first transient LED power fill is lower than the second transient LED power fill; and the second transient LED power fill is higher than the final LED power fill; and the first fluorescent power level is lower than the second fluorescent power level.

13. The lighting system of claim 1 wherein:

the initial LED power fill is lower than the first transient LED power fill;

the first transient LED power fill is higher than the second transient LED power fill;

the second transient LED power fill is lower than the final LED power fill; and the first fluorescent power level is lower than the second fluorescent power level.

14. The lighting system of claim 1, further comprising:

an open-face reflector for integrating the light from the fluorescent lamp and LEDs.

15. A method for controlling a hybrid fluorescent LED lighting system, the method comprising the steps of:

receiving a request for brightness/color;

measuring a combined output of the fluorescent lamp and LEDs;

gradually adjusting the output of the LEDs from an initial LED power fill to a first transient LED power fill;

stepping the fluorescent lamp from a first fluorescent power level to a second fluorescent power level, while stepping the LEDs from the first transient LED power fill to a second transient LED power fill such that the combined light output of the fluorescent lamp and LEDs remains the same; and gradually adjusting the output of the LEDs from the second transient LED power fill to a final LED power fill such that the combined light output of the fluorescent lamp and the LEDs reaches the received request for brightness/color.

16. The method of claim 15 further comprising the step of driving a specific range of the LEDs as necessary in order to fill-in variances in a spectrum range of the fluorescent lamp.

17. The method of claim 15 further comprising utilizing fluorescent lamp as the primary illumination source if the request for brightness/color is bright.

18. The method of claim 17 further comprising operating the LEDs at low power levels in parallel with the fluorescent lamps.

19. The method of claim 15 further comprising utilizing fluorescent lamp as the primary illumination source if the request for brightness/color is not dim.

20. The method of claim 15 further comprising modifying the color of light output by using a desired LED color.

21. The method of claim 15 further comprising utilizing the LEDs as the only illumination sources if the requested brightness/color is dim.

22. The method of claim 15 wherein:

the initial LED power fill is higher than the first transient LED power fill;

the first transient LED power fill is lower than the second transient LED power fill; and the second transient LED power fill is higher than the final LED power fill; and the first fluorescent power level is lower than the second fluorescent power level.

23. The method of claim 15 wherein:

the initial LED power fill is lower than the first transient LED power fill;

the first transient LED power fill is higher than the second transient LED power fill;

the second transient LED power fill is lower than the final LED power fill; and the first fluorescent power level is lower than the second fluorescent power level.

* * * * *